US005987866A

United States Patent [19]

Weeger et al.

[11] Patent Number: 5,987,866

[45] Date of Patent: Nov. 23, 1999

[54] SPINNING PROCESS UTILIZING ROVING FRAMES AND RING-SPINNING FRAMES

[75] Inventors: Hans-Peter Weeger, Hattenhofen; Ralf Wilhelmstätter, Kuchen, both of Germany

[73] Assignee: Zinser Textilmaschinen GmbH, Ebersbach/Fils, Germany

[21] Appl. No.: 09/173,370

[22] Filed: Oct. 15, 1998

[30] Foreign Application Priority Data

| | | | |
|---|---|---|---|
| Oct. 22, 1997 | [EP] | European Pat. Off. | 97118299 |
| Mar. 3, 1998 | [EP] | European Pat. Off. | 98103678 |

[51] Int. Cl.[6] ..... D01H 1/04

[52] U.S. Cl. ..... 57/67; 57/267; 57/281

[58] Field of Search ..... 57/281, 266, 267, 57/67, 264

[56] References Cited

U.S. PATENT DOCUMENTS

| | | | |
|---|---|---|---|
| 4,720,967 | 1/1988 | Guttler | 57/281 |
| 4,841,719 | 6/1989 | Sasaki et al. | 57/281 |
| 5,560,193 | 10/1996 | Sekiya et al. | 57/264 |
| 5,724,801 | 3/1998 | Kogiso et al. | 57/281 |

FOREIGN PATENT DOCUMENTS

| | | | |
|---|---|---|---|
| 0 308 215 A2 | 3/1989 | European Pat. Off. . | |
| 34 17 779 A 1 | 12/1984 | Germany . | |
| 34 17 779 C2 | 12/1984 | Germany . | |
| 36 30 214 A 1 | 3/1988 | Germany . | |
| 36 30 214 C 3 | 3/1988 | Germany . | |
| 37 09 540 A 1 | 10/1988 | Germany . | |
| 37 09 540 C 2 | 10/1988 | Germany . | |
| 37 34 275 A 1 | 4/1989 | Germany . | |
| 4-352821 | 7/1992 | Japan | 57/264 |
| WO 81/00264 | 2/1981 | WIPO . | |

OTHER PUBLICATIONS

Mitteilung, applic. no. 97118200.3–2314, dated Jun. 30, 1998.

Flugelzwirnmaschine Metumat mit automatischem Wechsel der Zwirnspulen, 2454 Draht, XP–002068267.

Was gibt es Neues im Baumwollspinnereimaschinenbau?, Grossman, XP–002068268.

Automatisierung des Flyers in Verbindung mit der Ring-spinnmaschine; Schulz, Gunter; XP–002068266.

*Primary Examiner*—William Stryjewski

*Attorney, Agent, or Firm*—Herbert Dubno

[57] ABSTRACT

Roving bobbins of a weight of about 5 kg, by contrast to standard bobbins with weights up to 3 kg, can be used in a spinning system in which the flyer frames are of the multi-axial drive type and are equipped with an automatic bobbin change mechanism which transfers the full bobbins to suspension carriage trains displaced thereby to ring-spinning machines and wherein the suspension carriage trains pass into the creels of the ring-spinning frames directly or are transferred from such suspension carriage trains to the creels.

4 Claims, 2 Drawing Sheets

SPINNING PROCESS UTILIZING ROVING FRAMES AND RING-SPINNING FRAMES

FIELD OF THE INVENTION

Our present invention relates to a spinning process utilizing a roving frame and a ring-spinning frame and suitable for use with short fibers such as cotton fibers, synthetic fibers with staple lengths like those of cotton fibers and also wool and synthetic fibers with staple lengths like those of wool and mixtures thereof.

BACKGROUND OF THE INVENTION

In conventional spinning processes for cotton spinning plants and combed yarn spinning plants operating with roving frames, also known as flyer frames, roving bobbins with weights up to about 3 kg are used. These bobbins have had a starting winding height of about 360 mm to about 410 mm (14 inches in the English system to 16 inches in the English system) and a greatest winding diameter of about 140 mm to 180 mm (5½ inches to 7 inches). These bobbin dimensions have generally been found to be an optimum in the past and have determined the production speed of the roving frame, the way in which the roving bobbins have been handled, the configuration of the creel of the ring-spinning machine and other factors in the processing of yarn to the point that there has been no basic change in these parameters of the roving yarn for many many years.

In recent years, however, machines and systems in the spinning field have undergone improvement and development. To the extent that such improved machines and concepts are utilized for the present invention, reference may be made to publications, especially patents, it being understood that the systems described in such publications or patents are the ones intended to be used for the present invention when a more detailed description has been avoided in favor of a citation of the particular reference.

For example, in terms of roving frames or flyer machines, so-called multi-axial flyers or roving frames have been described in which the machine has been equipped with a variety of independently controllable drives. A four-axis machine is described, for example, in German patent document DE 34 17 779 C2. This machine has independent drives for the flyer, the bobbins, the bobbin rail (i.e. the upwardly and downwardly movable support for the bobbins while they are within the flyers), and the drafting frame. These drives may be separate motors whose individual speeds are independently controllable. With such a system the conventional steplessly adjustable cone transmission which is used to drive the bobbins and the bobbin rail from a common prime mover is eliminated. The multi-axial drive has been described as enabling a simplified construction of the roving frame with the advantage of greater accuracy of control of the working elements, especially in terms of a speed difference between the flyers and the bobbins and the lifting speed of the bobbin rail. This permits a more precise building of the turns on the roving bobbin with a reduction in defects and elimination of slippage of the windings.

In connection with roving frames bobbin replacement mechanisms have also been described which permit the fully-wound, roving bobbins to be automatically removed from the bobbin rail and, for example, suspended from hangers of a suspension carriage train traveling as a rule overhead in the plant. The automatic bobbin-change system eliminates the heavy work which previously had to be performed by an operator in the doffing of the full bobbin from the flyer frame and the suspending of the full bobbin from the suspension carriage train. A suitable bobbin change or bobbin replacement mechanism has been described in German patent document DE 36 30 214 C3.

The suspension carriage systems which have been developed in recent years also include tracks which enable the suspension carriage trains to be introduced into the creels of the ring-spinning machines so that the full roving bobbins can remain suspended from the trains while they are in a creel. Such an arrangement has been shown and described, for example, in German patent document DE 37 09 540 C2.

In other cases automatic bobbin exchange units are used which can remove the full roving bobbins from the suspension carriage train and attach them to the hangers of the creel of the ring-spinning machine. Such an arrangement is described, for example, in German patent document DE 37 34 275 A1. In either case the muscle work required earlier by service personnel in the handling of overhead full roving bobbins is eliminated.

While all three of these developments have been available for a number of years, we are not aware that they have ever been combined before so as to enable the dimensions and weight of the bobbins which are handled to be substantially increased and hence the productivity of the system to be significantly increased.

OBJECTS OF THE INVENTION

It is therefore the principal object of the present invention to provide an improved method of producing yarn whereby bobbin weight and bobbin size can be significantly increased over the bobbin weight and bobbin size hitherto accepted as substantially the upper limits in the spinning field.

Another object of the invention is to provide a method which exploits known apparatus to achieve a particularly unique result in the field of spinning, especially as regards the productivity of such systems.

SUMMARY OF THE INVENTION

These objects and others which will become apparent hereinafter are attained, in accordance with the present invention in a method of producing yarn which comprises the steps of:

(a) feeding sliver to a multiplicity of stations of a multiaxial-drive flyer frame with independent drives for at least some of the driven elements thereof, the driven elements including flyers, bobbins, a bobbin rail and a drafting frame of the flyer frame, and controlling the independent drives to produce roving bobbins with a starting-winding height of about 460 mm to about 560 mm, a greatest-winding height of about 460 mm to about 560 mm and a greatest-winding diameter of about 190 mm to about 230 mm and a bobbin weight in excess of 4 kg;

(b) using an automatic bobbin-change mechanism on the flyer frame doffing fully wound bobbins from the flyer frame with the starting-winding height of about 460 mm to about 560 mm, the greatest-winding height of about 460 mm to about 560 mm and the greatest-winding diameter of about 190 mm to about 230 mm and the bobbin weight in excess of 4 kg, and suspending the fully wound bobbins from respective hangers of a suspension carriage train;

(c) displacing the fully wound bobbins on the suspension carriage train along a track to a creel of a ring spinning frame;

(d) storing the fully wound bobbins in the creel; and (e) spinning yarn in the ring spinning frame from fully wound bobbins transferred from the creel to the ring spinning frame.

The wound bobbin can be stored in the creel with the suspension carriage train or can be transferred from the suspension carriage train to the creel. Preferably the independent drives are so controlled as to produce fully wound bobbins of weight of about 5 kg and more.

In the past the 3 kg bobbin has been considered about the maximum which could be produced in the combination of flyer frames and ring-spinning systems as have been described. We have now found that by the aforementioned combination of the three more modern approaches in this field, namely, the multi-axial flyer frame with an automatic bobbin change mechanism and a suspension carriage system for conveying the fully wound roving bobbins to the creel of the ring-spinning machine, the substantially larger bobbins can be produced without handling difficulties. The invention allows the operation of the ring-spinning machine, especially for coarse rovings for longer periods of time with fewer interruptions for the bobbin replacement, permits increased transport capacity of the suspension carriage system, allows the ring-spinning machines to operate for longer periods of time between bobbin replacements and improve the quality of yarn produced by reducing the number of yarn connections and the thickened portions of the yarn which invariably result at these connections.

At one time it was proposed to utilize roving bobbins with a weight of 5 kg and a largest winding height of 480 mm and greatest winding diameter of 220 mm (see Melliand 1961, pages 1223–1230). This proposal was not, however, successful in practice and the article dealt with the problems of handling roving bobbins without presenting a solution. In point of fact, at that time, with the then state of the art of the flyers, it was not possible to produce the high number of winding layers of a roving at the increased diameter with the standard cone drive flyer frames. As a practical matter, the field rejected large bobbin systems of the type which readily can be produced with the present invention.

BRIEF DESCRIPTION OF THE DRAWING

The above and other objects, features, and advantages will become more readily apparent from the following description, reference being made to the accompanying drawing in which.

SPECIFIC DESCRIPTION

Figure 1:
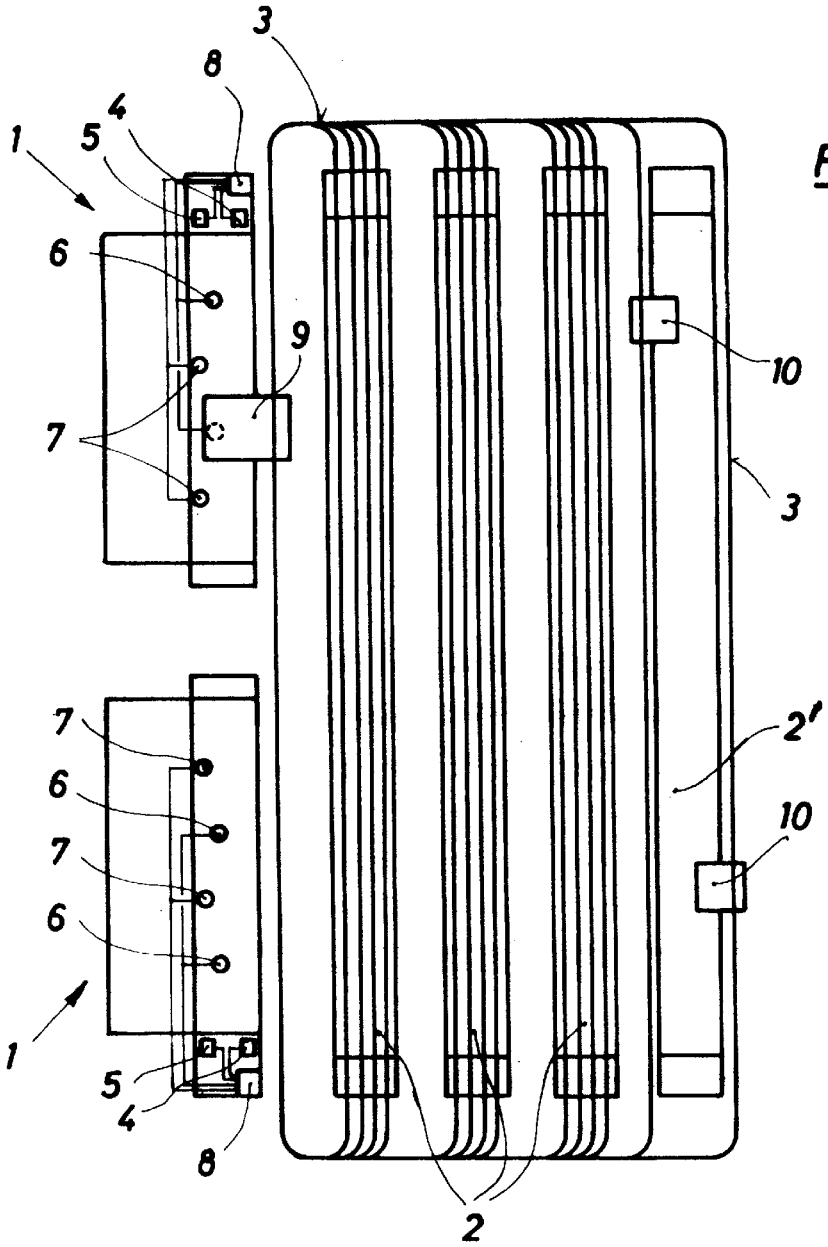
FIG. 1 is a plan view in highly diagrammatic form showing the layout of a spinning plant according to the invention in a first embodiment.
Figure 2:
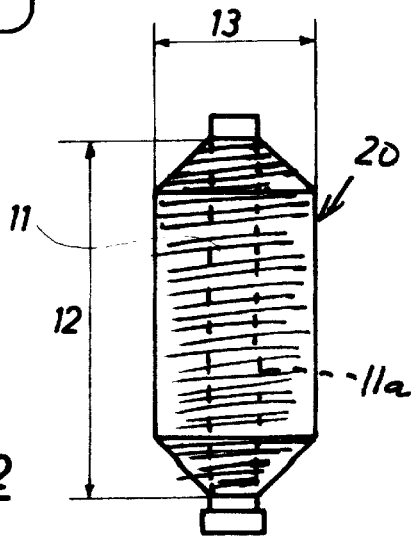
FIG. 2 is an elevational view of a roving bobbin used in this system.

As can be seen from FIG. 1, a spinning plant according to the invention can comprise, for example, two roving frames 1 and, for example, four ring-spinning machines 2 or 2', although other numbers of roving frames and spinning machines can be combined in the system if desired. Between the roving frames 1 and the ring-spinning machines 2, 2', there is a suspension carriage system 3 with tracks running through the ring-spinning machine and running to the roving frames. What has not been shown are storage facilities in the track system on which carriages laden with empty bobbin cores or full roving bobbins can be disposed, and, of course, the details of a system for replacing, on the suspension carriage train, full roving bobbins with empty bobbins cores. The suspension carriage trains can be driven by friction wheel sets or can be displaced by an operator, e.g. manually, along the desired paths and in a conventional manner (see DE 37 09 540 C2, for example) with hangers for the full bobbins, one of which is shown in FIG. 2, or the bobbin core seen in broken lines in FIG. 2 and represented at 11*a*.

The roving frame 1 can be of the type described in DE 34 17 779 C2 and can have a plurality of individually controlled motors so as to be a multi-axial drive machine. For example, each roving frame 1 can have a motor 4 for driving the drafting frame of the machine, a motor 5 for raising and lowering the bobbin rail, at least two motors 6 for driving the flyers and at least two motors 7 for driving the bobbins. The motors 5, 6 and 7 at least of the drive system are operated by a computer-controlled drive circuit represented at 8 so constructed that the building of the winding 11 on the core 11*a* is carried out with great precision, i.e. is exactly controllable, so that the winding is particularly stable and clean. The bobbin as a whole has-been represented at 20 in FIG. 2.

As FIG. 1 has shown diagrammatically, an automatic bobbin replacement unit 9 can be displaced along each of the roving frames 1 and serves to transfer full bobbins automatically from the roving frame to the suspension carriage train on the track system 3 and empty core sleeves from the latter of the spindles on the bobbin rail. In the embodiment shown in FIG. 1, the bobbin change unit 9 is located ahead of the roving frames 1 so that it can service both of the roving frames. Manual manipulation of the bobbins or the core sleeves is wholly unnecessary and hence any operator need not handle the heavy bobbins.

Figure 3:
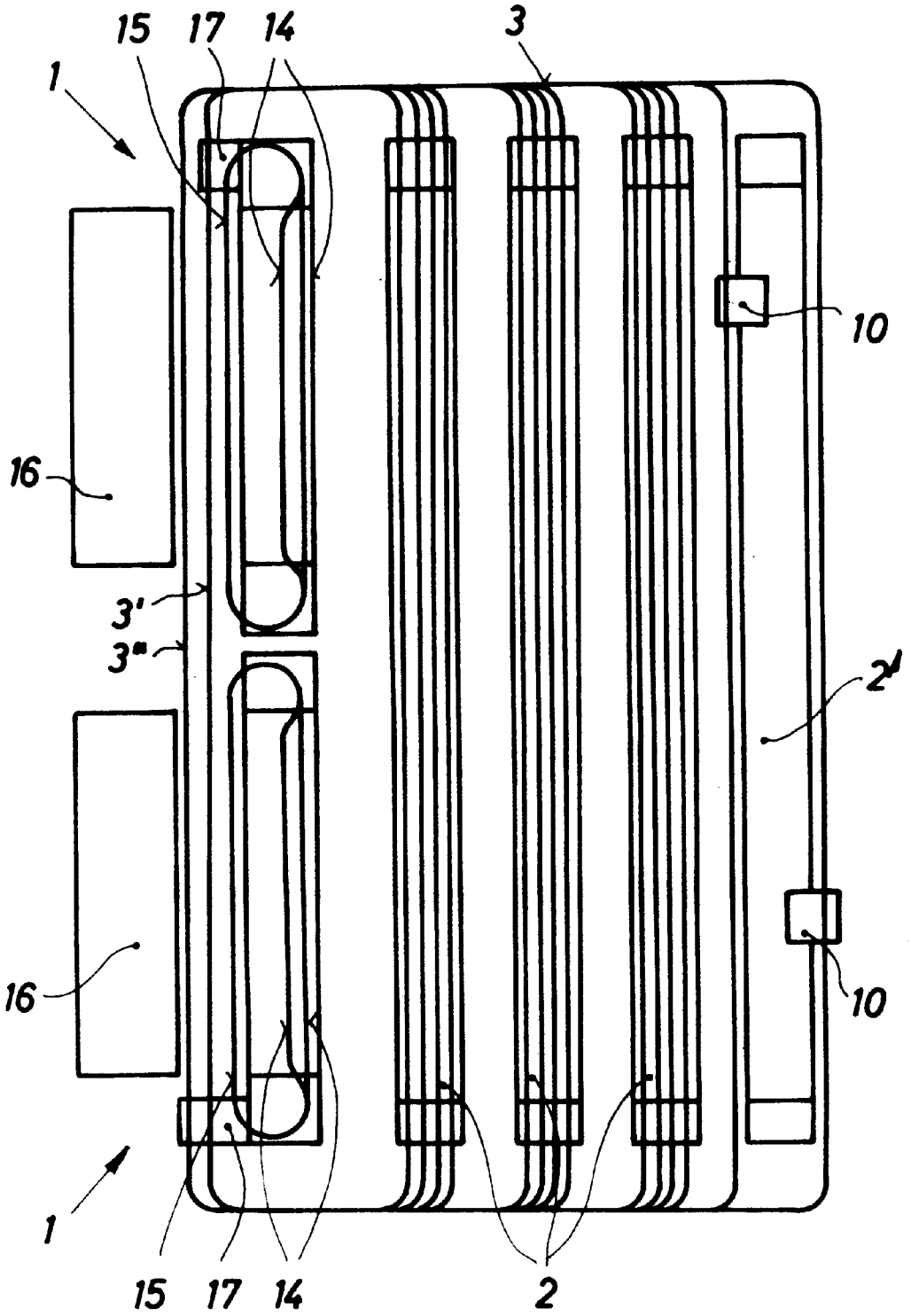
FIG. 3 is a view similar to FIG. 1 illustrating a second embodiment.

In th embodiment of FIG. 3, the automatic bobbin change arrangement which in FIG. 1 is of the type described in DE 36 30 214 C3, has been replaced by an automatic bobbin changer of the type described in EP 0 585 827 B1. The bobbin change unit 9 is however shown only highly schematically and in simplified form in FIG. 3.

In this embodiment as in the embodiment of FIG. 1, the various driven elements of the flyer frames 1 have separate and independently controllable drives including the drafting frame drive 4, the rail drive 5, the flyer motor 6, the bobbin motors 7 and the control unit 8 as has been described. Since these elements correspond to those of FIG. 1, they have not been separately illustrated.

The suspension track 14 extends between pairs of rows of flyers and bobbins and connects to a return track 15 forming a closed loop. In this closed loop 14, 15, the hanger trains are displaceable. The track system behind the return stretch 15 can be split into two tracks 3', 3" to allow the trains to travel along either of these tracks. In this case, the can fields 16 for the sliver cans must be set back somewhat further from the roving frames 1.

For bobbin replacement in this case, the suspension carriage train passes from the return track 15 into the track 14. With the double lifting and drop of the bobbin rail, the fully wound bobbins are affixed to the hangers and thereby transferred from the respective spindle while core sleeves are transferred from the hangers to the spindles. The suspension carriage train is then returned to the track 15.

Each roving frame 1 is provided with a respective bobbin/core transfer unit 17 or 17' by means of which bobbins from the suspension train displaced into the return track 15 are transferred to a suspension train in one of the track sections 3' or 3" and core sleeves are reciprocally transferred to the suspension carriage train in the return track 15 from the suspension carriage train in the main track 3' or 3". The transfer unit 17 and 17' can be operated independently from one another since the track 3 is split into two branches behind the roving frames 1. The transfer unit 17 services the branch 3' while the transfer unit 17' services the branch 3".

The creels of the ring-spinning machines 2 are so configured that the tracks 3 run through these creels, thereby enabling the suspension carriage trains to be held in readiness in the creel. Alternatively, the full bobbins 20 can be transferred to the creel without requiring that the suspension carriage train be stored therein. Here as well the operations take place automatically so that an operator need not handle the heavy bobbins. The ring-spinning machines can, as shown at 2' in FIGS. 1 and 3, be equipped with automatic bobbin changing units 10 as well. The bobbin changing units 10 can transfer roving bobbins from respective suspension carriages to the creel of the ring-spinning machine 2' and transfer empty sleeves from the creel to the ring-spinning machine 2'. On each machine side a respective bobbin change unit 10 can be provided.

With the process of the invention, roving bobbins 20 (FIG. 2) of a weight of about 5 kg can be produced with a greatest winding height 12 of about 460 mm to about 560 mm and a greatest winding diameter 13 of about 190 mm to about 130 mm, the coil structure or winding structure represented at 11 being highly precise. The bobbins need not be handled, e.g. lifted onto the hangers or removed therefrom manually either.

We claim:

1. A method of producing yarn, comprising the steps of:

(a) feeding sliver to a multiplicity of stations of a multiaxial-drive flyer frame with independent drives for at least some of the driven elements thereof, said driven elements including flyers, bobbins, a bobbin rail and a drafting frame of the flyer frame, and controlling said independent drives to produce roving bobbins with a starting-winding height of about 460 mm to about 560 mm, a greatest-winding height of about 460 mm to about 560 mm and a greatest-winding diameter of about 190 mm to about 230 mm and a bobbin weight in excess of 4 kg;

(b) using an automatic bobbin-change mechanism on said flyer frame doffing fully wound bobbins from said flyer frame with said starting-winding[]height of about 460 mm to about 560 mm, said greatest-winding height of about 460 mm to about 560 mm and said greatest-winding diameter of about 190 mm to about 230 mm and said bobbin weight in excess of 4 kg, and suspending the fully wound bobbins from respective hangers of a suspension carriage train;

(c) displacing said fully wound bobbins on said suspension carriage train along a track to a creel of a ring spinning frame;

(d) storing said fully wound bobbins in said creel; and (e) spinning yarn in said ring spinning frame from fully wound bobbins transferred from said creel to said ring spinning frame.

2. The method defined in claim 1 wherein said fully wound bobbins are stored in said creel by feeding said suspension carriage train into said creel.

3. The method defined in claim 1 wherein said fully wound bobbins are stored in said creel by transferring them from said suspension carriage train to said creel.

4. The method defined in claim 1 wherein said independent drives are controlled in step (a) so as to produce fully wound bobbins of a weight of about 5 kg.

* * * * *